US010376761B2

(12) United States Patent
Osborne

(10) Patent No.: US 10,376,761 B2
(45) Date of Patent: Aug. 13, 2019

(54) SOFTBALL BAT WITH UNIFIED TIP

(71) Applicant: Pure Sports Technologies, LLC, Charleston, SC (US)

(72) Inventor: Christopher Osborne, Charleston, SC (US)

(73) Assignee: Pure Sports Technologies, LLC, Charleston, SC (US)

( * ) Notice: Subject to any disclaimer, the term of this patent is extended or adjusted under 35 U.S.C. 154(b) by 0 days.

(21) Appl. No.: 15/828,942

(22) Filed: Dec. 1, 2017

(65) Prior Publication Data

US 2018/0154229 A1 Jun. 7, 2018

Related U.S. Application Data

(60) Provisional application No. 62/428,731, filed on Dec. 1, 2016.

(51) Int. Cl.

| | |
|---|---|
| ***A63B 59/00*** | (2015.01) |
| ***A63B 59/54*** | (2015.01) |
| *A63B 102/18* | (2015.01) |
| *A63B 59/51* | (2015.01) |
| *A63B 59/50* | (2015.01) |

(52) U.S. Cl.

CPC ..... *A63B 59/54* (2015.10); *A63B 59/50* (2015.10); *A63B 59/51* (2015.10); *A63B 2102/18* (2015.10); *A63B 2102/182* (2015.10); *A63B 2209/00* (2013.01); *A63B 2209/02* (2013.01); *A63B 2209/023* (2013.01)

(58) Field of Classification Search

CPC ..... A63B 59/54; A63B 59/51; A63B 59/52; A63B 59/50; A63B 2209/02; A63B 2209/023; A63B 2102/18; A63B 2102/182; A63B 2102/184

USPC ..... 473/564, 554

See application file for complete search history.

(56) References Cited

U.S. PATENT DOCUMENTS

| | | | | |
|---|---|---|---|---|
| 5,395,108 A * | 3/1995 | Souders | A63B 59/52 | 473/567 |
| 6,152,840 A * | 11/2000 | Baum | B29C 63/0021 | 473/564 |
| 6,776,735 B1 * | 8/2004 | Belanger | B29C 70/32 | 473/567 |
| 2002/0198071 A1 * | 12/2002 | Snow | A63B 59/54 | 473/564 |

(Continued)

*Primary Examiner* — Benjamin Layno

(74) *Attorney, Agent, or Firm* — Jeffrey T. Stover; Haynsworth Sinkler Boyd, P.A.

(57) ABSTRACT

A bat composed of composite materials is disclosed. Multiple layers of composite material is wound, weaved or interlaced around a mandrel to create a tubular structure composed of composite material. The tubular structure is cured and the mandrel is removed, leaving a hollow tubular structure. A composite material insert is inserted to the tip of the tubular structure, to seal the tubular structure. The knob portion of the structure is likewise sealed. The tubular structure is wrapped with fibrous material, such that the fibrous material encompasses the knob, body and tip of the structure. The resulting structure is a bat wherein the knob of the bat transitions to the barrel of the bat and the barrel of the bat transitions seamlessly to the tip of the bat, to create a continuous composite structure. This solid structure is then injection molded, with a solid bat tip and knob in place.

44 Claims, 8 Drawing Sheets

(56) References Cited

U.S. PATENT DOCUMENTS

| | | | | |
|---|---|---|---|---|
| 2004/0198539 | A1* | 10/2004 | Sutherland | B29C 70/48 473/567 |
| 2006/0293130 | A1* | 12/2006 | Guenther | B29C 70/32 473/564 |
| 2009/0174114 | A1* | 7/2009 | Chen | B29C 70/30 264/263 |
| 2013/0184108 | A1* | 7/2013 | Epling | A63B 60/42 473/567 |
| 2015/0018138 | A1* | 1/2015 | Slater | A63B 59/52 473/567 |
| 2016/0184681 | A1* | 6/2016 | Moritz | A63B 59/50 473/564 |

* cited by examiner

SOFTBALL BAT WITH UNIFIED TIP

CROSS-REFERENCE TO RELATED APPLICATIONS

This application claims the benefit of provisional patent application No. 62/428,731, filed Dec. 1, 2016, by the present inventor.

FEDERALLY SPONSORED RESEARCH

Not Applicable

SEQUENCE OR PROGRAM LISTING

Not Applicable

BACKGROUND

Technical Field

This invention generally relates to softball and baseball bats, and in particular to bats constructed from composite materials.

Prior Art

Conventionally, a baseball or softball bat (hereinafter a "bat") is manufactured from wood, metal (usually aluminum or titanium alloys) or composite material. Bats constructed from the aforementioned materials can also be crafted in numerous configurations to suit different styles of play. The material used to construct a bat affects the weight of the bat, swing speed, ball travel and durability of the bat. When constructing a bat, manufacturers seek materials that are durable but also materials that provide for optimal performance.

Although composite bats have been commercially available since the 1980s, it was not until the 2000s when composite bats began to gain popularity, rivaling the durability and performance of their wood and metal counterparts. The marketplace currently provides for bats constructed of all composite material, bats with composite handles and metal barrels, and bats with a composite shell covering a metal barrel.

Composite material generally refers to a refined plastic made of carbon materials that can be shaped and structured for a number of different purposes. Composite bats are traditionally constructed by wrapping yarns, cloths, or sleeves around a tubular structure, impregnating a resin into the yarns, cloths, or sleeves and curing the same. During this process, the tip of the bat barrel is open, lacking an end cap.

The end cap refers to a separate cap placed on the tip of the bat barrel during the final stages of the manufacturing process, just prior to finishing the cosmetics of the bat, such as paint and the addition of graphics and/or grips. After the bat structure is created, a separate end cap is added to the tip of the bat's barrel to create the nearly finished bat structure.

The current manufacturing process is problematic. Without a single, solid, composite structure, composite bats currently available in the marketplace are subject to tampering. Players in organized softball and baseball teams are required to use performance regulated bats. However, given the competitive nature of sports, some players may attempt to gain a competitive edge by modifying their bats. There are many different ways to alter a bat. Bat tampering encompasses changing the weight of a bat, adjusting a bat's wall thickness, and artificially "breaking-in" a bat.

When altering the weight or wall thickness of a bat, or artificially "breaking in" a bat, the end cap of the bat is generally removed. By removing the end cap of a bat, players who seek to tamper with their bats are given access to the interior workings of the bat. Once the bat is altered, an end cap can be reinserted and reattached. The interior of the bat can more easily be weighted, shaved or otherwise altered without affecting the outward appearance of the bat.

As noted herein, when manufacturing a bat from reinforced plastic, the traditional process of wrapping a tubular structure, as currently provided for in the art, necessitates the omission of an end cap during the manufacturing process. The top portion of the bat is later capped. Because the manufacturing of such conventional bats necessitate the later addition of an end cap at the tip of the bat barrel, versus the manufacture of a single, solid composite structure wherein the barrel of the bat transitions directly to the tip of the bat, such conventional bats are prone to modification or tampering. Such bats are easily modified due to the non-integrated, non-unified end cap of the bat, which can be removed and re-attached with relative ease. Modification or tampering of conventional bats may provide players with a competitive edge or violate the specifications of regulated bats. Modification and tampering may also create a safety issue due to the high speed at which a ball travels after it makes contact with a tampered or modified bat.

In addition, conventional bats constructed of composite material often have a minimal center of percussion, or as also know in the art, a "sweet spot." A bat's "sweet spot" refers to the area of the bat, which when hit, produces the least vibration sensation and maximum batted ball speed. When a ball strikes the "sweet spot" of a bat, a maximum amount of energy is transferred to the ball. This produces what some in the art refer to as the "trampoline effect." During the bat-ball collision, the barrel of the bat acts as a spring for the ball. If the barrel of the bat is stiff, then the ball compresses upon impact and energy is lost during the compression and expansion process. Where the barrel of a bat is softer, the ball loses less energy during the bat-ball collision, thereby increasing the speed of the ball post collision. For most bats, the "sweet spot" is located approximately five to seven inches from the end of the bat's barrel.

Composite bats that are currently known in the art have a limited center of percussion, or "sweet spot." Therefore, composite bats do not traditionally perform as well as metal or wood bats. The limited "sweet spot" is in part due to the manufacturing processes currently in place. There is a need in the art for a composite bat with a larger "sweet spot" so as to maximize bat performance. Such results can be achieved and are disclosed as an embodiment of the present invention. By providing for a highly controlled winding, weaving or interlacing process, the fiber angles of the composite materials are regulated and the center of percussion is expanded. The present invention improves the process of constructing bats made of reinforced plastic. Specifically, the present invention contemplates multiple layers or walls of composite material that is wound, weaved or interlaced around a tapered or cylindrical axle, known as a mandrel, to create a tubular structure that will serve as the skeleton of the bat. By controlling the layering, placement or angling of the composite material used to construct a bat, the "sweet spot" of the bat is increased.

In addition, a bat of the present invention minimizes the sting effect that players may experience as a result of a poorly hit ball. When a baseball makes contact with a bat, the ball causes the bat to vibrate. Where a ball makes contact with the bat outside of the bat's center of percussion, such vibrations may result in a painful sensation in the hands of a player. Bat manufacturers have attempted to eliminate and, or reduce vibrations with the use of two piece bats. In such instances, bats are made in two parts and are glued together. Manufacturers have also attempted to eliminate and, or reduce vibrations with absorbers. Absorbers include placing additional wrapping at or near the handle portion of the bat or grips.

The present invention minimizes the sting effect that players encounter. The structure of a bat of the present invention, the use of dissimilar materials in the present invention, and the manner in which such materials are bonded discourages the transmission of vibrations from the ball to the bat and ultimately to a player's hands. At or near the taper transition point on the body of a bat of the present invention, the angling of materials adjusts. Vibrations that result from the bat and ball impact dissipate before reaching a player's hands.

There is a need in the art for a composite bat that improves player performance and limits bat tampering. By limiting bat modification and tampering, the integrity of the sport is promoted and sport safety is improved.

BRIEF SUMMARY OF THE INVENTION

The present invention relates to softball and baseball bats and more particularly to the process of molding the same.

A bat of the present invention is created by first manufacturing a tubular structure that is composed of composite material. With the use of machinery, a single, continuous strand of composite material is wound, weaved or interlaced around a tapered or cylindrical axle, known as a mandrel. Multiple layers, or walls, of composite material are added over the mandrel to create the interior structure, or skeleton, of the bat. Throughout the winding, weaving or interlacing process, the angling of the composite material is highly controlled such that fiber angles increases as the material approaches the bat's center of percussion. Fiber angles increase or decrease as the material move closer to or further away from the bat's center of percussion.

The angling of the composite material directly affects the performance of the bat. By controlling the angling of composite material as it approaches and moves away from the bat's center of percussion, the size of the center of percussion can be increased. This improves the bat's performance. In addition, a bat of the present invention minimizes the sting effect that players may, from time to time, experience as a result of a poorly hit ball. This is accomplished with the use of dissimilar materials along the body of the bat, the bonding of such materials and the controlled angling and layering of such materials.

A thin layer of plastic or other suitable material is placed between each layer of composite material. The newly created tubular structure is cured, using processes currently known in the art. After the curing process, the mandrel, which is traditionally composed of aluminum, shrinks and is removed. A cured tubular structure composed of composite material, with open tip, remains. The resulting tubular structure is composed of precisely placed fibers of composite material.

A form fitted composite material insert is inserted into the open tip of the tubular structure and is secured in place with adhesive. The insertion of the insert seals the tubular structure to create a single, solid vessel. A single, solid composite structure wherein the barrel of the structure transitions directly to the tip of the structure is created.

The body of the tubular structure is then wrapped, woven or covered with fibrous material, such as: fiber-reinforced plastic wherein the reinforcement fiber is glass; carbon fiber; and, or aramid fibers. Lead or other weighted metal is inserted into the knob and barrel portion of the tubular structure to achieve a desired balance of weight and balance of weight. Fibrous material is then wrapped over the tip and knob of the tubular structure, so as to reinforce the single, solid composite structure of the tubular structure. Said fibrous material is held in place with adhesive and/or the use of threads of cotton, hemp, or other material twisted together to form a thin, string material that secures the fibrous material to the tubular structure.

The tubular structure is placed in a pre-constructed mold. The tubular structure may then undergo a vacuum forming process. In some instances, the structure does not go through a vacuum forming process. A polymer coating is then injected around the tubular structure. Following the injection molding process, the bat is complete absent the addition of cosmetic additions like paint, graphics or grips.

When removed from the mold, the finished bat is a single, completely sealed, solid structure, with hollow body and a smooth and continuous edge. Additional structural modifications are not required. No additional component parts are added to the bat body.

DRAWINGS—FIGURES

The present invention will become more fully understood from the detailed description herein and the accompanying drawings which are given by way of illustration only and thus are not limitive of the present invention. In the drawings, closely related figures have the same number but different alphabetic suffixes.

Drawings—Figures

DRAWINGS-Reference Numerals

Figure 1:
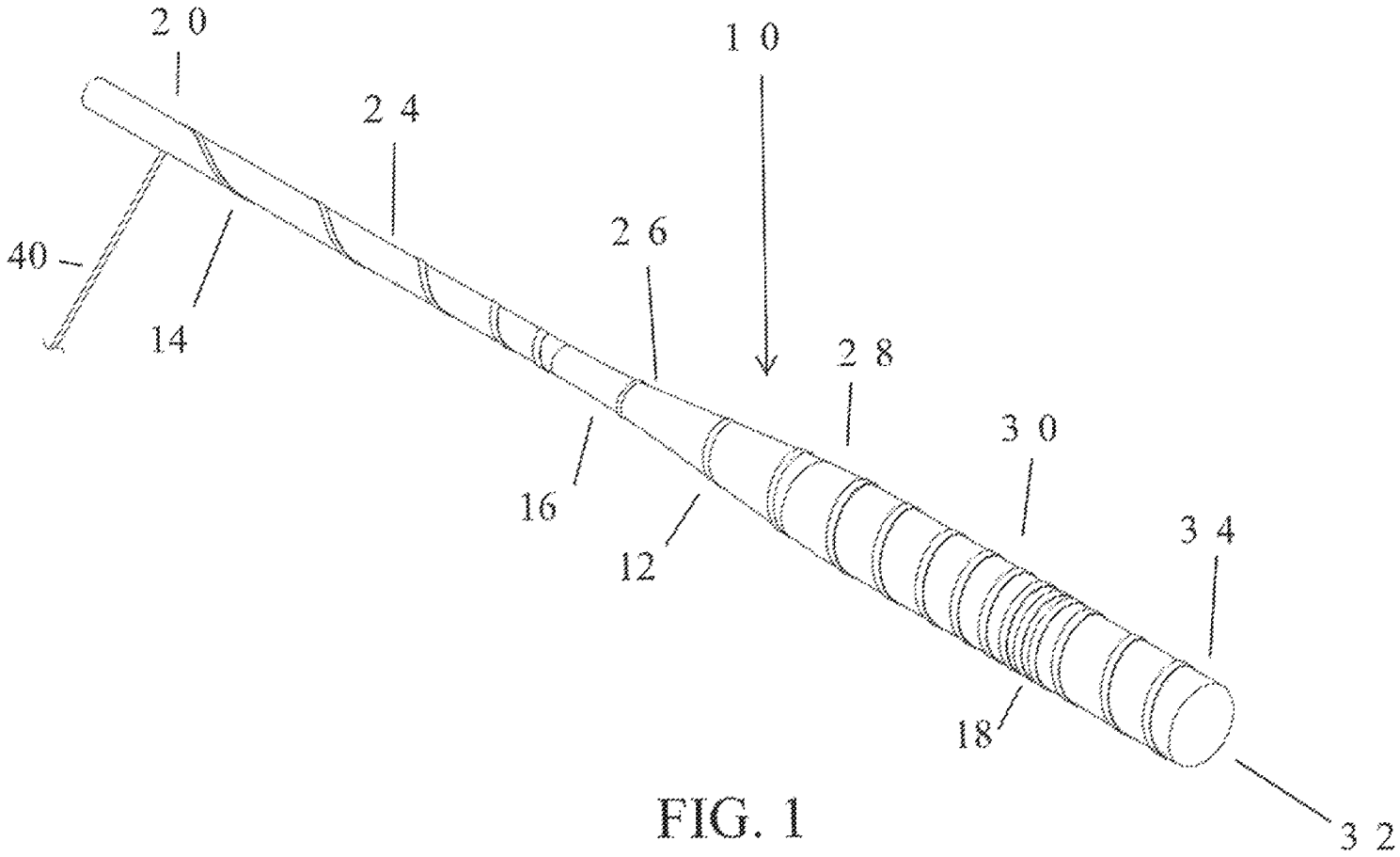
FIG. 1 is a side perspective view of a mandrel, as composite material is wound, weaved or interlaced around the body of the mandrel, in accordance with an embodiment of the present invention.

| Reference No. | Part |
|---|---|
| 10 | mandrel |
| 12 | longitudinal axis |

-continued

| DRAWINGS-Reference Numerals | |
|---|---|
| Reference No. | Part |
| 14 | proximal region |
| 16 | central region |
| 18 | distal region |
| 20 | knob |
| 22 | grip |
| 24 | handle |
| 26 | taper |
| 28 | barrel |
| 30 | center of percussion |
| 32 | tip |
| 34 | outer surface |
| 36 | inner surface |
| 38 | hollow core |
| 40 | composite material |
| 42 | tubular structure |
| 44 | insert |
| 46 | interior surface of insert |
| 48 | outer surface of insert |
| 50 | interior lip of insert |
| 52 | exterior lip of insert |
| 54 | gripping points |
| 56 | fibrous material |
| 58 | string |
| 60 | mold |
| 62 | bat |

DETAILED DESCRIPTION OF THE INVENTION

The embodiments disclosed herein are discussed in the context of a baseball or softball bat and the process of manufacturing the same because of the applicability and usefulness in such a field. More specifically, the bat of the present invention may be used to limit bat tampering, improve player performance, improve bat durability, and eliminate concerns of player safety.

First Embodiment—FIGS. 1, 2, 3, 4, 5, 6, 7 and 8

In accordance with an embodiment of the present invention, FIG. 1 generally depicts the manufacture of the core of a bat of the present invention. The core of the bat is a tubular structure that forms the internal structure, or backbone, of the bat.

Said tubular structure is formed with the use of a tapered or cylindrical axle, known as a mandrel 10. The mandrel 10 is a tubular structure that is generally of the same size and dimensions of the interior of a bat of the present invention. In an embodiment, said mandrel 10 ranges from 25.0 centimeters in length to 214.0 centimeters in length. The diameter of said mandrel 10 ranges from 5.0 millimeters in diameter, at its thinnest part, to 7.0 centimeters in diameter, at its thickest part. It is further contemplated that said mandrel tapers from the distal region 18 to the proximal region 14. Beginning at or near the taper 26, the body of the mandrel tapers as it transitions from the barrel 28 to the knob 20. However, it is contemplated that the mandrel 10 may be of any size and shape that will allow said device to operate according to its intended function.

Said mandrel may be fabricated from any metal material. Non-limiting examples of a metal include aluminum alloys, stainless steel, cobalt-chrome or titanium alloys, or any blend thereof.

In alternative embodiments, it is contemplated that a multi-piece metal, composite or plastic mandrel may be utilized. It is further contemplated that an inflatable or disposable mandrel may be utilized.

Referring to FIG. 1, with the use of machinery (not shown), multiple layers of composite material 40 are interlaced around the body of the mandrel 10. In an embodiment, it is contemplated that nine separate and distinct layers of composite material 40 will be interlaced around the body of the mandrel; however, in alternative embodiments, more or less layers of composite material 40 may be interlaced around the body of the mandrel 38.

In an embodiment, the composite material 40 is composed of reinforced plastics known also as polymer-matrix composite (PMC) and fiber reinforced plastics (FRP). Strands of composite material 40 are utilized. Generally, said strands range from 2.0 millimeters in width to 12.0 millimeters in width, and 0.1 millimeters in thickness to 0.5 millimeters in thickness. However, it is contemplated that the composite material 40 may be of any dimension that will allow said material to operate according to its intended function. It is further contemplated that said composite material 40 may be formed of any materials that is maintains a high specific strength (strength-to-weight ratio) and specific stiffness (stiffness-to-weight ratio).

For a first layer, a single, continuous strand of composite material 40 is wound, weaved or interlaced around the outer surface 34 of the body of the mandrel 10, beginning at the proximal region 14 of the mandrel and continuing to the distal region 18 of the mandrel. It is contemplated that the composite material 40 will cover 100.0% of the body of the mandrel.

Throughout the winding, weaving or interlacing process, the angling of the composite material 40 is highly controlled such that fiber angles increase as the material approaches the central region 16 of the mandrel. Fiber angles increase or decrease as the material moves closer to or further away from the central region 16 of the mandrel. It is contemplated that the angling of the composite material will vary between 20 degrees and 90 degrees. The angling of the composite material 40 will increase as the strands of composite material 40 approach the center of percussion 30. The angling of the composite material 40 will decrease as the strands of composite material 40 move away from the center of percussion 30.

Next, a thin layer of plastic or other suitable material then covers the mandrel 10. Additional layers of a single, continuous strand of composite material 40 are wound, weaved or interlaced around the body of the mandrel 10, along the longitudinal axis 12, beginning at the proximal region 14 of the mandrel and continuing to the distal region 18 of the mandrel. It is contemplated that the angling of the composite material will vary between 10 degrees and 90 degrees. It is contemplated that the composite material 40 will cover 90.0% of the body of the mandrel during the placement of each subsequent layer of composite material 40.

In an alternative embodiment, it is contemplated that multiple strands of composite material 40, up to forty (40) strands, may be wound, weaved or interlaced around the body of the mandrel 10, versus the use of a single strand.

A thin layer of plastic or other suitable material is placed between each layer of composite material 40. The use of a shear plane forces the bat to break apart at certain desired intervals and locations versus at random intervals and locations, thereby allowing the end user to "break in" the bat more quickly.

The mandrel 10, interlaced with composite material 40, is cured, using traditional means known in the art. After the curing process, the mandrel 10, which in an embodiment of the present invention, is composed of aluminum, shrinks and is manually removed. A cured tubular structure 42 composed of composite material 40 remains. The resulting tubular structure 42 is composed of precisely placed composite material 40 pieces. It mirrors the overall shape and dimensions of a finished bat of the present invention.

Following the curing process, the walls of the resulting tubular structure 10 range from 0.1 to 0.5 centimeters in thickness. However, in alternative embodiments, the resulting walls of the tubular structure 10 may be of any dimension that will allow said structure to operate according to its intended function.

Figure 2:
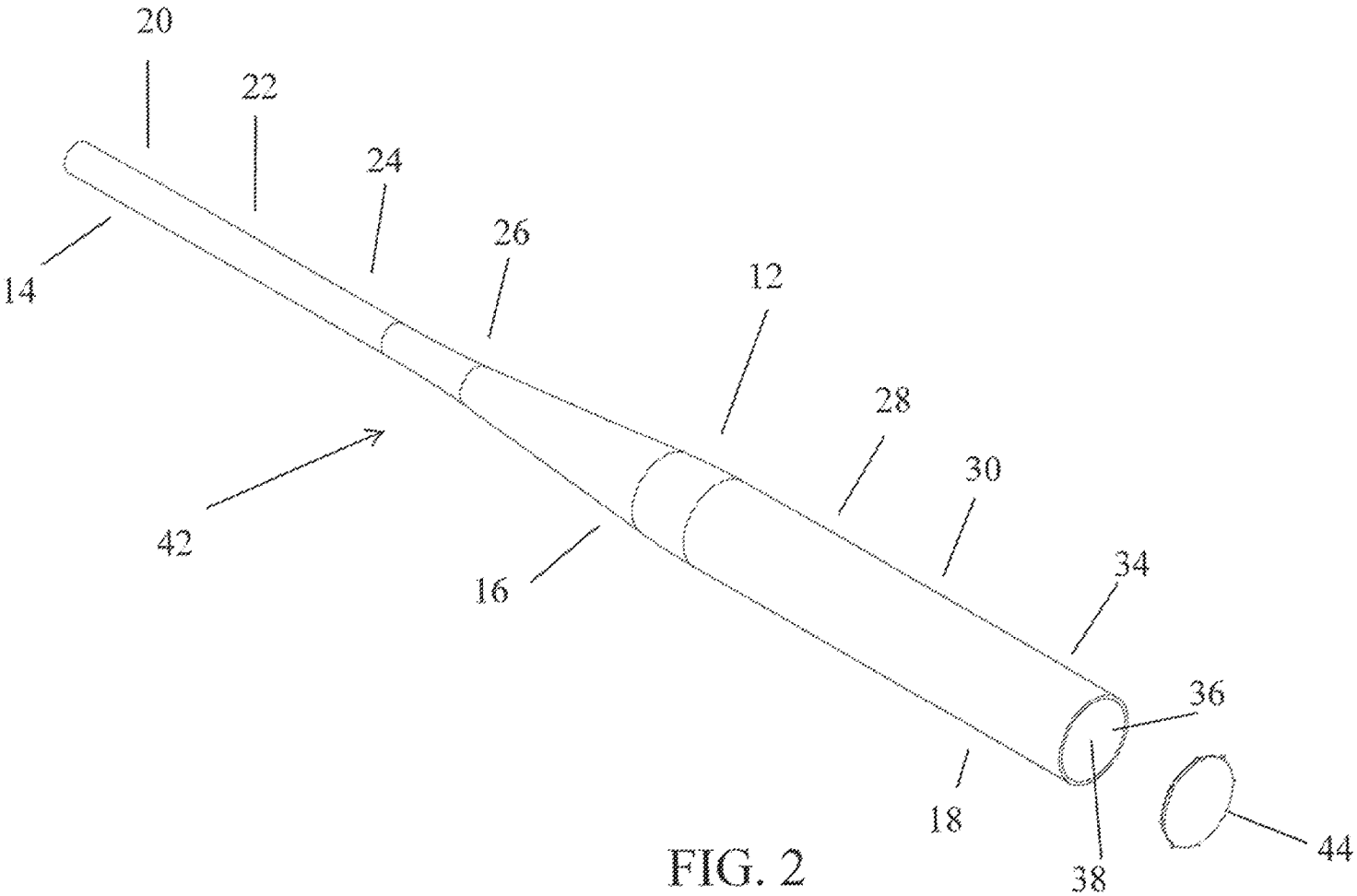
FIG. 2 is a side perspective view of a bat in accordance with an embodiment of the present invention.

Referring to FIG. 2, said tubular structure 42 is comprised of three regions: (i) the proximal region 14; (ii) the central region 16; and (iii) the distal region 18. Located on the outer surface 34 of the proximal region 14 is a knob 20, grip 22 and handle 24. The knob 20 is immediately adjacent to the grip 22. The grip 22 is immediately adjacent to the handle 24.

Beginning at or near the taper 26, the proximal region 14 of the tubular structure transitions, increasing slightly in diameter, to the central region 16 of the tubular structure. The central region 16 of the tubular structure 42 comprises the barrel 28 of the tubular structure. The center or percussion 30 is located within the confines of the outer surface 34 of the barrel 28. The tubular structure 42 transitions from the central region 16 to the distal region 18.

The tip 32 of the tubular structure 42 is located on the distal region 18. The tip 32 is located on the outer surface 34 of the tubular structure. The outer surface 34 transitions to a hollow core 38. The hollow core 38 is in constant communication with the interior surface 36 of the tubular structure 42.

The hollow core 38 maintains a similar shape and structure as the outer surface 34 of the tubular structure. In an embodiment, it is contemplated that the hollow core 38 may be gas-filled, vacuum-sealed, or atmospheric.

Lead or other weighted metal (not shown) is inserted into the knob 20 and barrel 28 portion of the tubular structure 42 to achieve a desired balance of weight and balance of weight.

As further shown on FIG. 2, an insert 44 is placed on or within the tip 32 of the tubular structure. The insert 44 maintains a roughly circular shape and is sized to accommodate the interior surface 36 of the tubular structure 42. The insert 44 comprises an interior lip 50, located on and in constant communication with the interior surface of the insert 46. The insert 44 further comprises an exterior lip 52 that is located on and is in constant communication with the outer surface of the insert 48. The interior lip 50 and exterior lip 52 are immediately adjacent to one another and mirror the circular shape of the insert 44.

Located on exterior lip 52 and in accordance with an embodiment, is a plurality of gripping points 54. Said gripping points 54 are of such size and shape to accommodate the inner surface 36 of the tubular structure 42. In an alternative embodiment, it is contemplated that said insert 44 may not have any gripping points or as few as one gripping point.

In an embodiment, the insert 44 is composed of the same material that comprises the composite material tubular structure 42. However, it is contemplated that the insert 44 may be formed of any material that maintains a high specific strength (strength-to-weight ratio) and specific stiffness (stiffness-to-weight ratio), so as to carry out the intended function of the insert.

Figure 3:
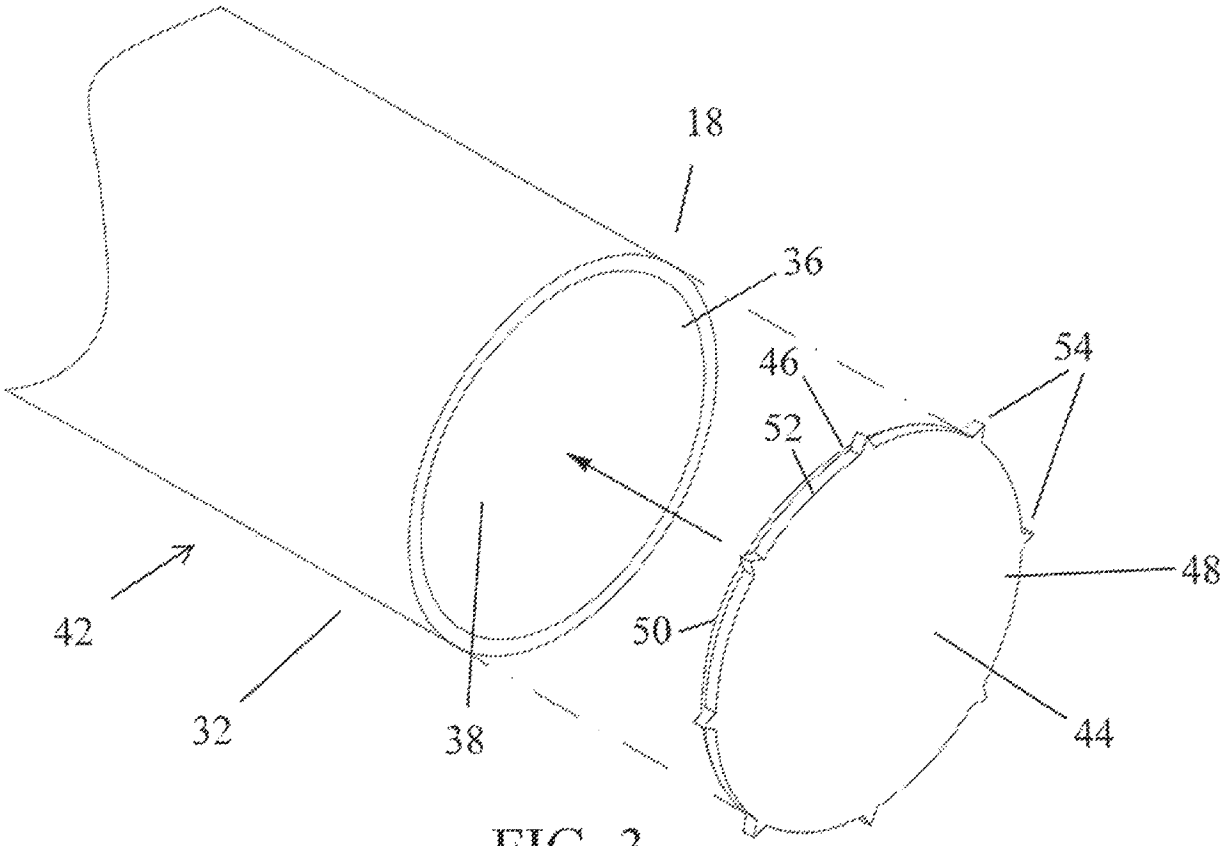
FIG. 3 is a side perspective view of the tip of a bat, as an insert is attached to the tip of said bat, in accordance with an embodiment of the present invention.
Figure 4:
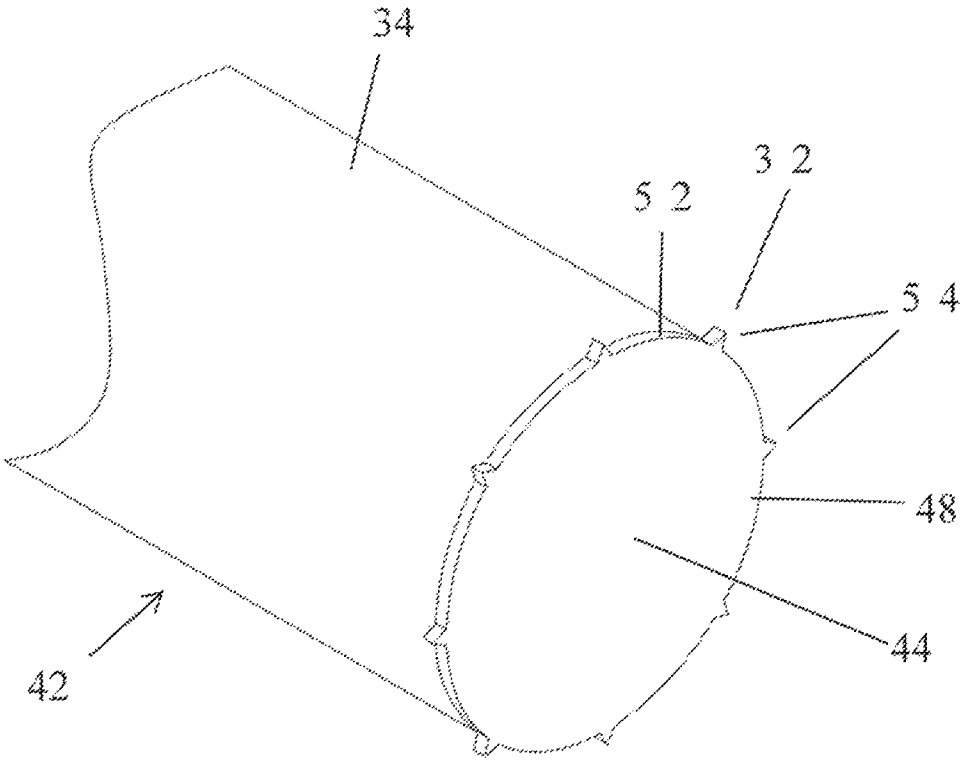
FIG. 4 is a side perspective view of the tip of a bat in accordance with an embodiment of the present invention.

Referring to FIGS. 3 and 4, the insert 44 is inserted into the open tip 32 of the tubular structure 42. The interior lip 50 is manually placed so that the interior lip 50 touches and attaches to the inner surface 36 of the tip 32 of the tubular structure 42. The exterior lip 52 is placed such that touches and seals the outer surface 43 of the tip 32 of the tubular structure 42.

In an embodiment, gripping points 54 of the insert 44 further secure the insert 44 to the tubular structure 42. The insert 44 is further secured to the tubular structure 42 with the use of adhesive. In an alternative embodiment, it is contemplated that the insert 44 may be secured to the tubular structure 42 by any means that will seal the tubular structure.

Referring to FIG. 4, a single, solid composite structure is formed wherein the barrel 28 of the tubular structure 42 transitions directly to a sealed tip 32.

Figure 5:
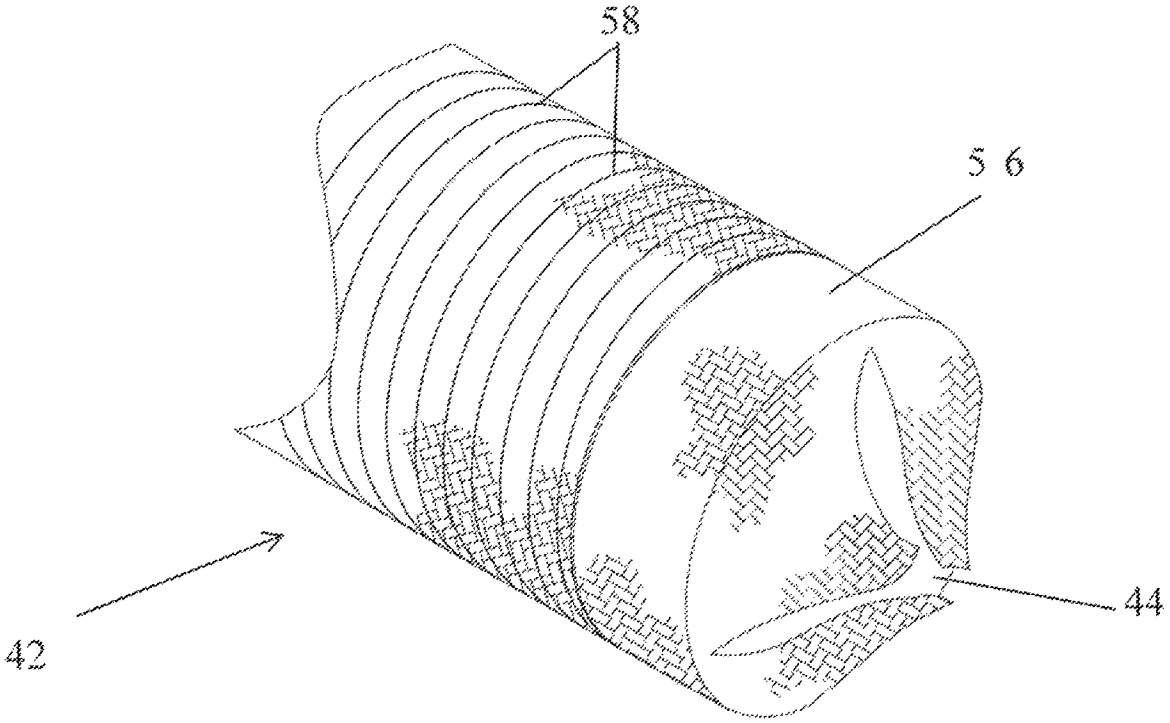
FIG. 5 is a side perspective view of the tip of a bat, as the tip of said bat is wrapped, woven or covered with fibrous material, in accordance with an embodiment of the present invention.
Figure 6:
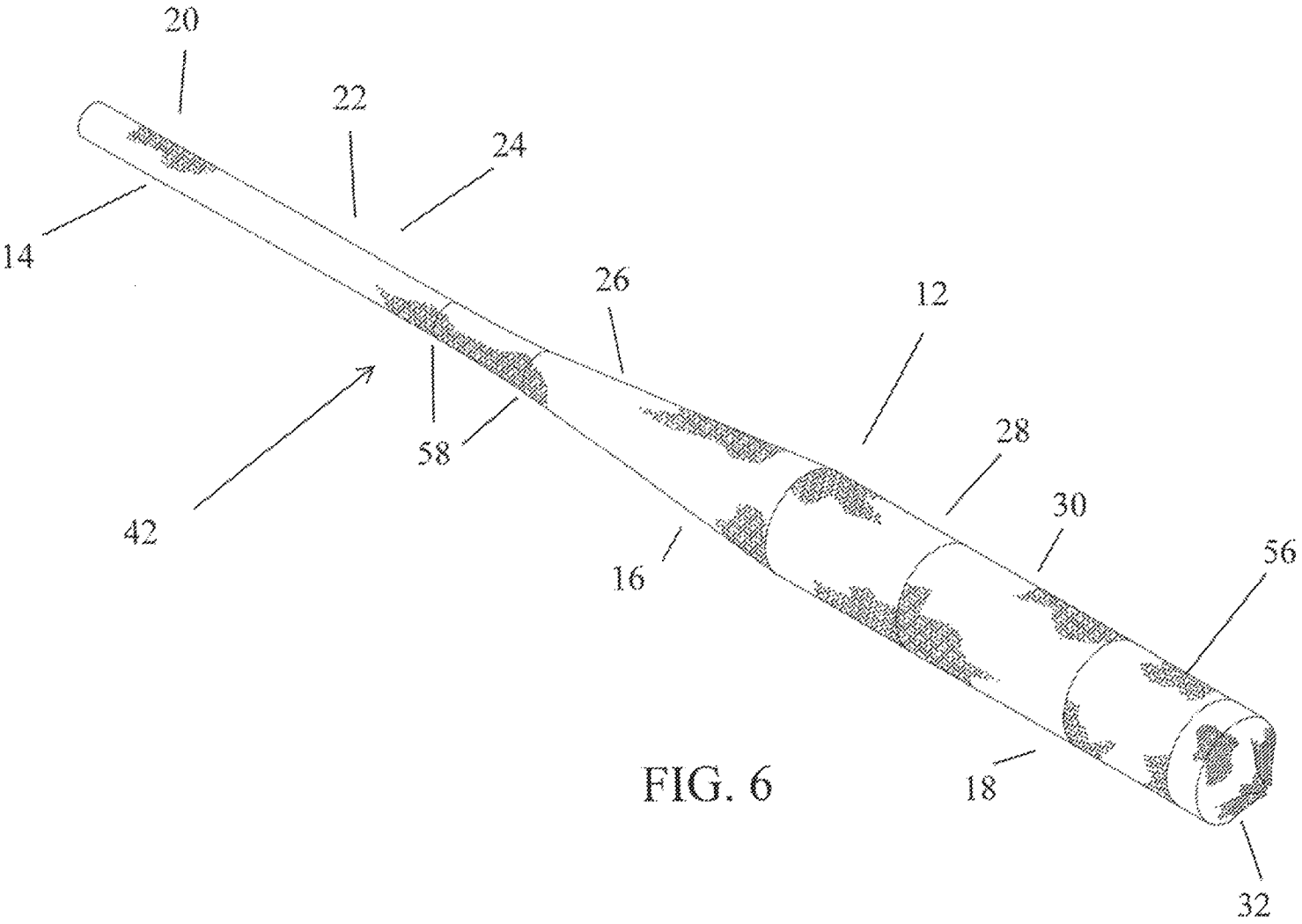
FIG. 6 is a side perspective view of a bat, as the body of the bat is wrapped, woven of covered with fibrous material, in accordance with an embodiment of the present invention.

Referring to FIGS. 5 and 6, the body of the tubular structure 42 is then wrapped, woven or covered with fibrous material 56, such that said material fully encompasses the tubular structure 42. Fibrous material 56 is likewise wrapped over the tip 32 of the tubular structure 42, such that the fibrous material 56 is manually folded over and completely encompasses the outer surface of the insert 48, as attached and secured to the tubular structure 42.

In an embodiment, said fibrous material 56 is secured in place with the use of adhesive and/or the use of threads of cotton, hemp, carbon, plastic, or other material to form a thin, string material 58 that secures the fibrous material to the tubular structure. The resulting structure is a single, solid, sealed tubular structure 42 wrapped in fibrous material 56.

Said fibrous material 56 may be composed of sheets, strands or such other configuration and may be of any dimension as will permit the wrapping and, or weaving of said material around a tubular structure 42.

In an embodiment, such fibrous material may be composed any natural or synthetic substance or a combination of such substances. Non-limiting examples include: fiber-reinforced plastic wherein the reinforcement fiber is glass; carbon fiber; and, or aramid fibers.

Figure 7:
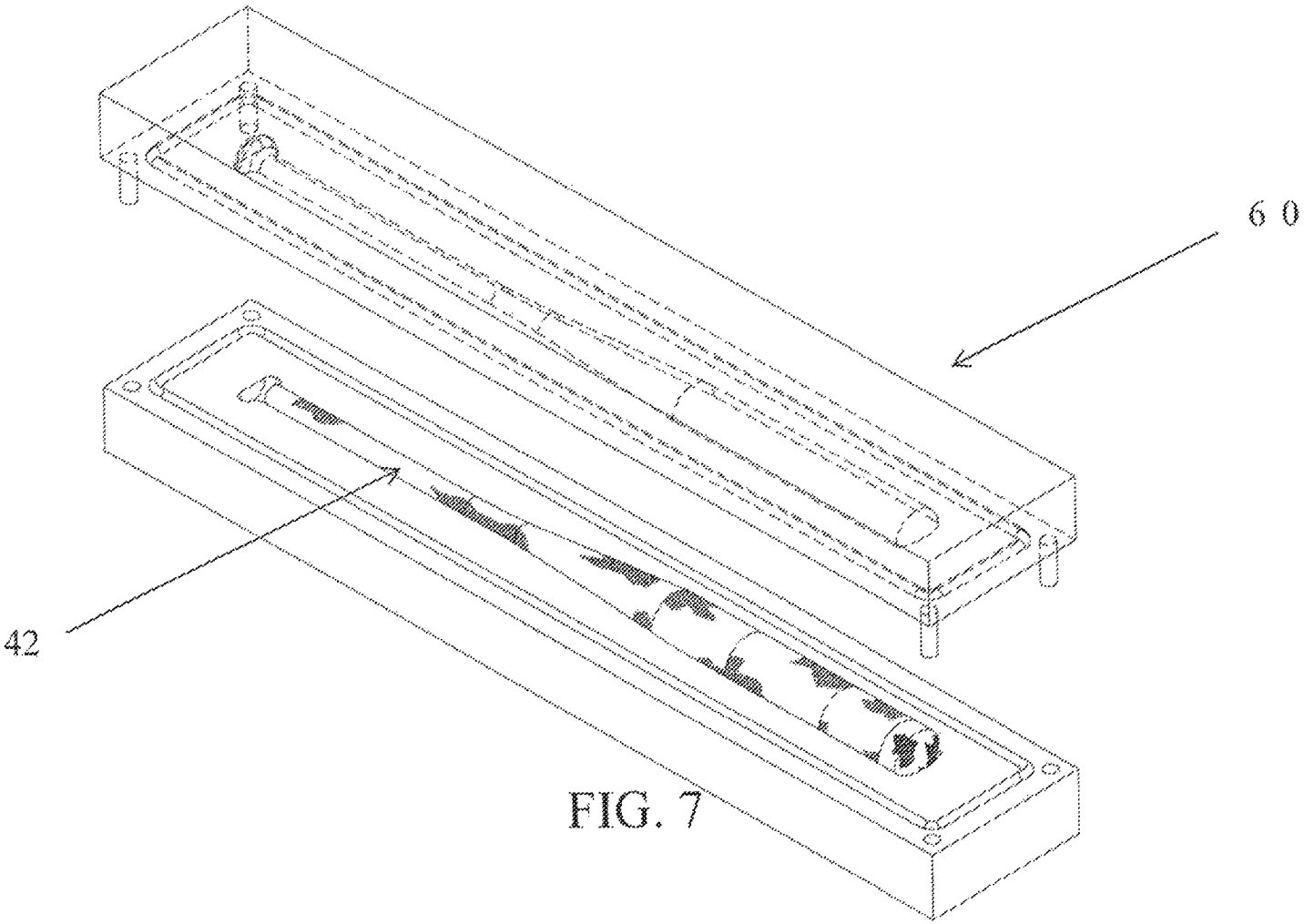
FIG. 7 is a side perspective view of a bat of the present invention placed in a mold.

Referring to FIG. 7, the tubular structure 42 is placed in a pre-constructed mold 60. A polymer coating is then injected around the tubular structure 42.

Figure 8:
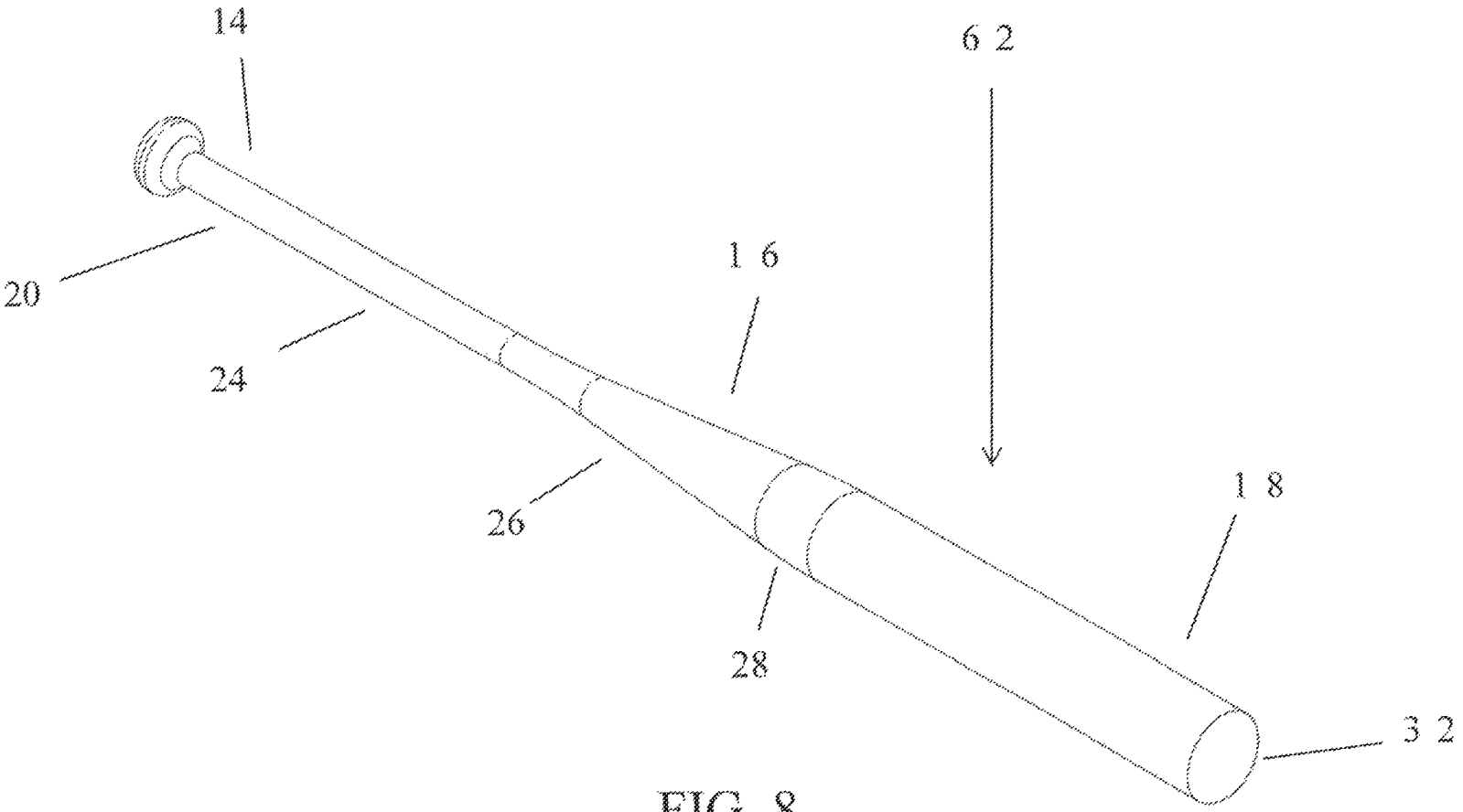
FIG. 8 is a side perspective view of a bat in accordance with an embodiment of the present invention.

Referring to FIG. 8, following the injection molding process, a bat 62 of the present invention is manufactured. Said bat is a solid, sealed vessel. Said bat 62 comprises all structural components, including a knob 20 and a fully unified tip 32. Additional structural components, such as an end cap, are not added.

What is claimed is:

1. A bat comprising:

a handle portion;

a barrel portion defining a tubular structure and a hollow core;

a tapered portion connecting said handle portion to said barrel portion;

a tip portion of the barrel portion located opposite the handle portion and including an interior surface defined by the hollow core; and an insert is placed on or within the tip portion, and is sized to accommodate the interior surface of the tip portion of the tubular structure;

wherein the outer body of said tubular structure is composed of alternative layers of composite material and plastic, wrapped in fibrous material that encompasses the insert, and the handle portion of said tubular structure transitions to the barrel portion and the barrel portion transitions to the tip portion of the tubular structure, to create a continuous composite structure.

2. A bat of claim 1 wherein the composite material is angled around the body of the tubular structure such that the angling of said composite material increases as said composite material approaches the central region of the tubular structure and the angling of said composite material decreases as said composite material moves away from the central region of the tubular structure.

3. A bat of claim 1 wherein the composite material is positioned around the body of the tubular structure at angles between 20 degrees and 90 degrees.

4. A bat of claim 1 wherein the composite material is wound around the body of the tubular structure.

5. A bat of claim 1 wherein the composite material is weaved around the body of the tubular structure.

6. A bat of claim 1 wherein the composite material is interlaced around the body of the tubular structure.

7. A bat of claim 1 wherein there are nine separate and distinct layers of composite material placed around the body of the tubular structure.

8. A bat of claim 1 wherein the composite material is composed of reinforced plastics.

9. A bat of claim 1 wherein the composite material is composed of polymer-matrix composite.

10. A bat of claim 1 wherein the composite material is composed of fiber reinforced plastics.

11. A bat of claim 1 wherein said fibrous material is composed of sheets.

12. A bat of claim 1 wherein said fibrous material is composed of strands.

13. A bat of claim 1 wherein said fibrous material is composed of fiber reinforced plastic.

14. A bat of claim 1 wherein said fibrous material is secured in place with the use of adhesive.

15. A bat of claim 1 wherein said fibrous material is secured in place with the use of threads of cotton.

16. A bat of claim 1 wherein said fibrous material is secured in place with the use of threads of hemp.

17. A bat of claim 1 wherein said fibrous material is secured in place with the use of threads of carbon.

18. A bat of claim 1 wherein said fibrous material is secured in place with the use of threads of plastic.

19. A bat of claim 1 wherein weighted metal is inserted into the handle portion and barrel portion of the tubular structure.

20. A bat of claim 1, wherein said insert comprises a circular shape that is sized to accommodate the interior surface of said tubular structure.

21. A bat of claim 1, wherein said insert comprises an interior lip and an exterior lip that are immediately adjacent to one another, wherein the interior lip is located on and is in constant communication with an interior surface of said insert and the exterior lip is located on and is in constant communication with an outer surface of the insert.

22. A bat of claim 1, wherein said insert comprises at least one gripping point.

23. A bat of claim 1, wherein said insert comprises a plurality of gripping points.

24. A bat of claim 1, wherein said tip portion is formed during the manufacturing process so as to create a continuous composite structure.

25. A method of constructing a bat comprising the steps of:

placing multiple layers of composite material around the outer surface of the body of a mandrel, such that during the process of placing said composite materials around said mandrel, the angling of said composite material increases as said composite material approaches the central region of the mandrel and the angling of said composite material decreases as said composite material moves away from the central region of the mandrel;

placing a layer of plastic material between each layer of composite material;

curing said mandrel;

manually removing said mandrel, leaving a hollow, tubular structure, that comprises a handle portion, a barrel portion defining said hollow core, a tapered portion connecting said handle portion to said barrel portion and a tip portion;

inserting an insert into the tip portion of said tubular structure, wherein said insert maintains a circular shape and is sized to accommodate the interior surface of the tubular structure and is secured to the tip portion of said tubular structure by at least one gripping point;

wrapping said tubular structure with fibrous material such that the fibrous material encompasses the body of the tubular structure;

wrapping the tip of said tubular structure with fibrous material, such that the fibrous material is manually folded over and completely encompasses the outer surface of the insert;

inserting a knob portion into the handle portion of the tubular structure;

inserting weighted metal into the knob portion and the barrel portion of the tubular structure;

placing said tubular structure in a pre-constructed mold; and injecting a polymer coating around the body of said tubular structure to create a solid and sealed vessel.

26. A method of claim 25 wherein during the process of placing composite material around the mandrel, the angling of said composite material is between 20 degrees and 90 degrees.

27. A method of claim 25 wherein during the process of placing composite material around the mandrel, said composite material is wound around the mandrel.

28. A method of claim 25 wherein during the process of placing composite material around the mandrel, said composite material is weaved around the mandrel.

29. A method of claim 25 wherein during the process of placing composite material around the mandrel, said composite material is interlaced around the mandrel.

30. A method of claim 25 wherein during the process of placing composite material around the mandrel, nine separate and distinct layers of composite material are placed around the outer body of the mandrel.

31. A method of claim 25 wherein said composite material is composed of reinforced plastics.

32. A method of claim 25 wherein said composite material is composed of polymer-matrix composite.

33. A method of claim 25 wherein said composite material is composed of fiber reinforced plastics.

34. A method of claim 25 wherein said fibrous material is composed of sheets.

35. A method of claim 25 wherein said fibrous material is composed of strands.

36. A method of claim 25 wherein said fibrous material is composed of fiber reinforced plastic.

37. A method of claim 25 wherein said fibrous material is secured in place with the use of adhesive.

38. A method of claim 25 wherein said fibrous material is secured in place with the use of threads of cotton.

39. A method of claim 25 wherein said fibrous material is secured in place with the use of threads of hemp.

40. A method of claim 25 wherein said fibrous material is secured in place with the use of threads of carbon.

41. A method of claim 25 wherein said fibrous material is secured in place with the use of threads of plastic.

42. A method of claim 25 wherein said knob and barrel is weighted with lead.

43. A method of claim 25 wherein said knob is weighted prior to the insertion of said insert.

44. A method of claim 25 wherein said insert contains a plurality of gripping points.

* * * * *